US011445282B2

(12) United States Patent
Ding et al.

(10) Patent No.: US 11,445,282 B2
(45) Date of Patent: Sep. 13, 2022

(54) CAPACITIVE ON-BODY DETECTION

(71) Applicant: Google LLC, Mountain View, CA (US)

(72) Inventors: Yao Ding, San Jose, CA (US); Kenneth Albanowski, Fremont, CA (US)

(73) Assignee: Google LLC, Mountain View, CA (US)

( * ) Notice: Subject to any disclaimer, the term of this patent is extended or adjusted under 35 U.S.C. 154(b) by 0 days.

(21) Appl. No.: 16/671,306

(22) Filed: Nov. 1, 2019

(65) Prior Publication Data

US 2020/0396530 A1 Dec. 17, 2020

Related U.S. Application Data

(60) Provisional application No. 62/860,834, filed on Jun. 13, 2019.

(51) Int. Cl.
*H04R 1/10* (2006.01)

(52) U.S. Cl.
CPC ..... *H04R 1/1041* (2013.01); *H04R 1/1016* (2013.01); *H04R 1/1025* (2013.01); *H04R 1/1075* (2013.01); *H04R 2420/07* (2013.01)

(58) Field of Classification Search
CPC combination set(s) only.
See application file for complete search history.

(56) References Cited

U.S. PATENT DOCUMENTS 9,354,731 B1 * 5/2016 Pance ..... G06F 3/0445
9,743,171 B1 * 8/2017 Anderson ..... H04R 1/1016
9,794,675 B2 10/2017 Rye et al.
2006/0233413 A1 * 10/2006 Nam ..... H04R 1/1041 381/380
2011/0007908 A1 1/2011 Rosener et al.
2011/0182458 A1 * 7/2011 Rosener ..... G06V 40/1306 381/384
2013/0182867 A1 * 7/2013 Knowles ..... H04B 7/0834 381/74
2015/0078573 A1 * 3/2015 Nicholson ..... H04R 1/1041 381/74

(Continued)

FOREIGN PATENT DOCUMENTS

WO 2019032360 A1 2/2019

OTHER PUBLICATIONS

International Search Report and Written Opinion for International Application No. PCT/US2019/059315 dated Jan. 29, 2020. 12 pages.

(Continued)

*Primary Examiner* — Duc Nguyen
*Assistant Examiner* — Assad Mohammed
(74) *Attorney, Agent, or Firm* — Colby Nipper PLLC

(57) ABSTRACT

The technology provides a device, such as a wireless earbud, with capacitive sensing capabilities. For instance, the device may include a housing, and a conductive support positioned inside the housing. The device may further include one or more processors configured to measure a combined capacitance of a plurality of electrodes at the conductive support. Based on the combined capacitance, the one or more processors may detect that the conductive support is inserted into an ear. The one or more processors may then operate the device in a first mode based on detecting that the conductive support is inserted into an ear.

20 Claims, 11 Drawing Sheets

(56) References Cited

U.S. PATENT DOCUMENTS

| | | | | |
|---|---|---|---|---|
| 2017/0078780 | A1* | 3/2017 | Qian | H04R 1/1016 |
| 2017/0339484 | A1* | 11/2017 | Kim | A61B 5/165 |
| 2018/0199140 | A1 | 7/2018 | Husung et al. | |
| 2019/0052951 | A1* | 2/2019 | Kofman | H04R 1/1041 |
| 2019/0098390 | A1* | 3/2019 | Carino | H04R 5/033 |

OTHER PUBLICATIONS

International Preliminary Report on Patentability for International Application No. PCT/US2019/059315 dated Dec. 23, 2021. 7 pages.

* cited by examiner

400

CAPACITIVE ON-BODY DETECTION

CROSS-REFERENCE TO RELATED APPLICATIONS

This application claims the benefit of the filing date of U.S. Provisional Patent Application No. 62/860,834 filed Jun. 13, 2019, the disclosure of which is hereby incorporated herein by reference.

BACKGROUND

"Truly wireless", when used in connection with earbuds, is typically used to refer to a pair of earbuds (one for each ear) that connect to an audio source wirelessly, with no wire between the earbuds. A pair of truly wireless earbuds may be used for a number of purposes, such as listening to audio signals transmitted by a device, noise cancellation, voice calls, and translation. Sensors are often included in these wireless earbuds for detecting different conditions, such as whether the wireless earbuds are loose or inserted into ears.

BRIEF SUMMARY

The present disclosure provides for a device comprising a housing, a conductive support attached to the housing, and one or more processors configured to: measure a combined capacitance of a plurality of electrodes at the conductive support; detect, based on the combined capacitance, whether the conductive support is inserted into an ear; and operate the device in a first mode based on detecting that the conductive support is inserted into the ear.

The combined capacitance may be based on a combination of at least a first capacitance of a first electrode of the device and a second capacitance of a second electrode of the device, wherein the first and second electrodes of the device may be arranged and configured to be connected through the ear when the conductive support is inserted into the ear. In an exemplary embodiment, the device may include a detector being configured to measure the combined capacitance based on at least one current passing through at least one of the first and second electrodes The one or more processors may be further configured to determine that the combined capacitance meets a predetermined threshold capacitance, wherein detecting whether the conductive support is inserted into the ear is based on whether the combined capacitance meeting the predetermined threshold capacitance. The one or more processors may be further configured to detect, based on the combined capacitance, that the conductive support is within a predetermined distance from a skin surface inside the ear.

The conductive support may have a tubular shape configured to be inserted into an ear canal.

The device may further comprise a speaker. The one or more processors may be further configured to control the speaker to generate an audio output when operating in the first mode.

The one or more processors may be further configured to operate the device in at least one further mode and/or to trigger at least one action based on the measured combined capacitance. For example, the one or more processors may be further configured to operate the device in a second mode based on detecting that the conductive support is not inserted into the ear. The second mode may be a standby mode.

The device may further comprise a communication module; wherein the one or more processors may be further configured to control the communication module to send a message instructing another electronic device to generate audio output when operating in the second mode. The one or more processors may be further configured to, based on the combined capacitance, detect at least one further state of the device in addition to detecting whether the conductive support is inserted into an ear or not. For example, the one or more processors may be further configured to detect, based on the combined capacitance and as at least one further state, whether the device is inserted incorrectly in the ear.

The device may further comprise a non-conductive cap positioned around the conductive support outside the housing, wherein, when the conductive support is inserted into the ear, the non-conductive cap comes in direct contact with a skin surface of the ear. The one or more processors may be further configured to detect, based on the combined capacitance, whether the earbud is inserted incorrectly; and generate, based on detecting that the earbud is inserted incorrectly, an output including an instruction to adjust the non-conductive cap. Generally, the conductive cape may include at least one opening for sound. The one or more processors may be further configured to determine whether the combined capacitance meets a first predetermined threshold capacitance or a second predetermined threshold capacitance being higher than the first predetermined threshold capacitance. Detecting whether the conductive support is inserted into the ear or not may then be based on whether the combined capacitance meeting the first predetermined threshold capacitance and detecting whether the device is in another state may be based on whether the combined capacitance meeting the higher second predetermined threshold capacitance. For example, the combined capacitance measured without a non-conductive cap may have a much larger value greater than the first predetermined threshold capacitance, such as a value meeting a second predetermined (higher) threshold capacitance. Based on detecting that the device is not being worn correctly, the one or more processors may generate an output instructing the user to correctly insert the device.

The device may further comprise a speaker, a battery, and a circuit board; wherein the speaker, the battery, the circuit board, and the conductive support are connected to a common ground; and wherein the combined capacitance includes a first capacitance of the conductive support, and a second capacitance across the speaker, the battery, and the circuit board.

The device may further comprise a detector for measuring the combined capacitance; and a transient-voltage-suppression diode connected in parallel to the detector.

The device may further include an optical sensor positioned inside the housing; wherein the one or more processors may be further configured to: receive sensor data from the optical sensor; and detect, further based on the sensor data from the optical sensor, that the conductive support is inserted into the ear The present disclosure further provides for a system comprising a first earbud and one or more processors. The first earbud may include a first housing and a first conductive support attached to the first housing. The one or more processors may be configured to measure a first combined capacitance of a first plurality of electrodes at the first conductive support; detect, based on the first combined capacitance, that the first conductive support is inserted into an ear; and operate the first earbud in a first mode based on detecting that the first conductive support is inserted into the ear. The first mode may include controlling the first earbud to generate an audio output.

The system may further include a second earbud. The second earbud may include a second housing and a second conductive support attached to the second housing. The one or more processors may be further configured to measure a second combined capacitance of a second plurality of electrodes at the second conductive support; detect, based on the second combined capacitance, that the second conductive support is not inserted into an ear; operate the second earbud in a second mode based on detecting that the second conductive support is not inserted into the ear. The second mode may be a standby mode.

The present disclosure still further provides for measuring, by one or more processors, a combined capacitance of a plurality of electrodes at a conductive support attached to a housing of a device; detecting, by the one or more processors based on the combined capacitance, whether the conductive support is inserted into an ear; determining, by the one or more processors whether the conductive support is inserted into the ear; and operating, by the one or more processors, the device in a first mode based on determining that the device is inserted into the ear.

Detecting, by the one or more processors based on the combined capacitance, whether the conductive support is inserted into an ear may comprise detecting, by the one or more processors based on the combined capacitance, whether the conductive support is within a predetermined distance from a skin surface inside the ear, and determining, by the one or more processors based on the combined capacitance, whether the conductive support is inserted into the ear may comprise determining, by the one or more processors based on the combined capacitance, whether the conductive support is within the predetermined distance from the skin surface inside the ear.

The method may further comprise receiving, by the one or more processors, sensor data from an optical sensor; and detecting, by the one or more processors further based on the sensor data from the optical sensor, whether the earbud is being worn.

DETAILED DESCRIPTION

Overview

Figure 1A:
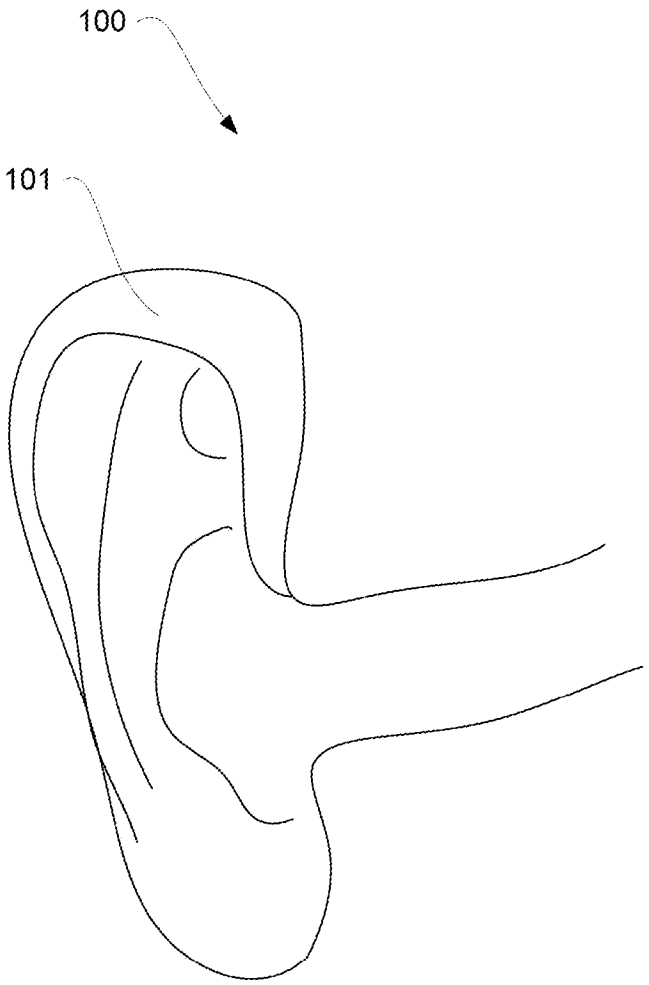
FIGS. 1A and 1B are pictorial diagrams illustrating example earbud in accordance with aspects of the disclosure.
Figure 1A:
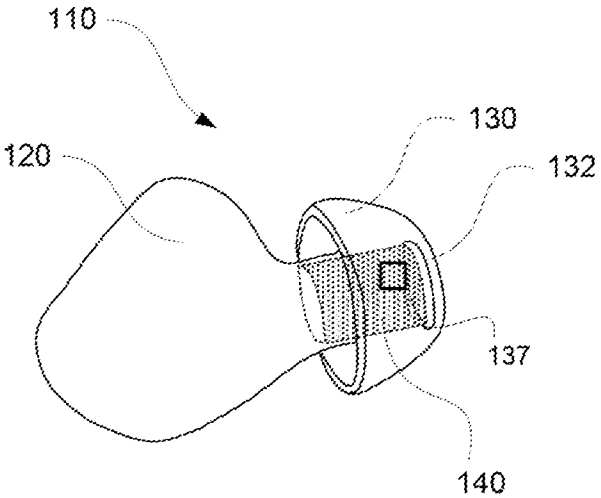

The technology generally relates to on-body detection for a device. For example, earbuds and the systems in which they operate may be configured to provide enriched user experience based on whether the earbuds are being worn by the user. For instance, when the earbuds are being worn (such as being worn in the ear versus held in a person's hand or placed in a container), audio may be routed to speakers in the earbuds instead of a speaker in another device, such as a paired phone. As another example, if a call comes in when the earbuds are not being worn, audio may be routed to a speaker in another device, such as the paired phone. Further, to conserve battery power and battery life, the earbuds may enter a standby mode when not being worn. Accurately detecting whether earbuds are properly worn may prevent issues that arise from inaccurate detection. For instance, inaccurate detection of the earbuds being worn may cause audio to be routed incorrectly, which may result in inconvenience to the user and others. For example, routing music to a speaker in a paired phone in a quiet library or a crowded street, instead of the earbuds in the user's ears, may cause inconvenience to the user and others. Inaccurate detection of the earbuds being worn may also cause the earbuds to remain in active modes at unnecessary times, which may result in a wasteful use of battery power and a reduced battery life. In this regard, a pair of earbuds are provided with capabilities to detect whether the earbuds are being worn.

For instance, each of the earbuds may include a housing, and a conductive support attached to the housing. By way of example, the conductive support may have a snout-like shape configured to be inserted into the ear. In some instances, the conductive support may have a tubular shape and act as a sound port for the earbud, in addition to providing mechanical support. Moreover, a non-conductive cap may be provided around the conductive support. For example, the non-conductive cap may be configured to come in direct contact with a skin surface of the ear to provide a secure and comfortable fit. In some instances, a diode, such as a transient-voltage-suppression diode, may be provided to protect the conductive support from static charges.

Each of the earbuds may further include one or more processors configured to measure one or more capacitances, such as a combined capacitance of a plurality of electrodes at the conductive support. For example, when not being worn, current passing through the conductive support may be affected to a lesser extent, or not affected at all, by the body of the user. As such, the processors may measure one combined capacitance at the conductive support when the earbuds are not worn. In contrast, when being worn, current passing through the conductive support may be affected to a greater extent by the body of the user. As such, the processors may measure another combined capacitance at the conductive support when the earbuds are worn.

Thus, based on the measured combined capacitance at the conductive support, the processors may detect whether the earbud is being worn. For example, if the measured combined capacitance meets a predetermined threshold capacitance, the processors may determine that the earbud is being worn. Otherwise, the processors may determine that the earbud is not being worn. In some instances, the processors may further make the determination based on sensor data from at least one another sensor, such as an optical sensor, or an IMU. Accordingly, the one or more processors may, for example, take into account both the determination based on the sensor data and the combined capacitance. Thereby, reliability of the determination may be increased.

The processors may then operate the earbuds based on the detection. For instance, the processors may operate the earbud in a first mode based on detecting that the earbud is being worn. By way of example, the processors may route audio to be outputted by a speaker of the earbud, or control the earbud to enter an active mode from a standby mode. The processors may operate the earbud in a second mode based on detecting that the earbud is not being worn. For example, the processors may route audio to be outputted by a speaker in another device, or control the earbud to enter the standby mode.

In another aspect, the processors may be configured to further detect whether the earbud is inserted correctly into the ear. For instance, when the non-conductive cap is removed from the earbud when being worn, the conductive support may come in direct contact with the skin. As such, the processors may measure a combined capacitance at the conductive support that is different from the case when the earbud is worn with the non-conductive cap, and also different from the case when the earbud is not being worn at all. For example, the combined capacitance measured without the non-conductive cap may have a much larger value greater than the predetermined threshold capacitance, such as a value meeting a predetermined high threshold capacitance. Based on detecting that the earbud is not being worn correctly, the processors may generate an output instructing the user to correctly insert the earbud.

The technology is able to detect, with relatively high accuracy, whether a person is currently wearing a device on their body, such as whether an earbud is being worn in an ear. Accuracy is enhanced by the use of a capacitive component that is inserted into the ear, which permits the component to maintain a consistent distance from the skin surface inside the ear. Accuracy may be further enhanced by the component's geometry, which provides a relatively large surface area despite the small form factor of the device. Different types of sensors may additionally be used for on-body detection, which may further reduce false positives. Accurate on-body detection may result in longer battery life because, among other reasons, the earbud may enter a standby state, or otherwise decrease its power usage when it is not being worn. In addition, user experience may be improved by routing audio to the most appropriate device. User experience may be further improved by detecting when the earbud is worn incorrectly and providing instructions to the user to help the user adjust the earbud.

Example Systems

Figure 1B:
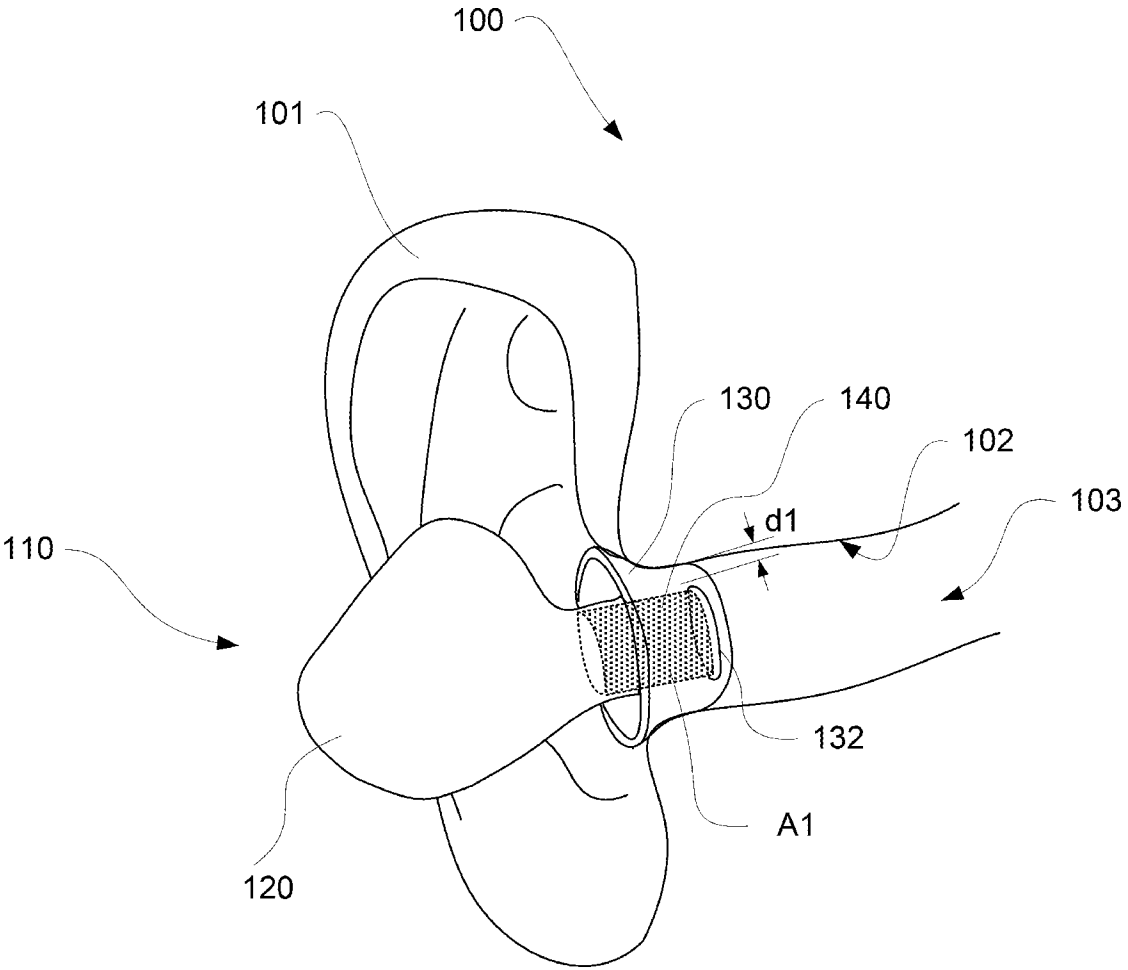

FIGS. 1A and 1B illustrate an example device, in particular, an earbud 110. FIG. 1A shows the earbud 110 in a position wherein it is not being worn inside a user's ear 101, and FIG. 1B shows the earbud 110 at a position wherein it is being worn inside ear 101. By way of example, when being worn inside ear 101, at least a portion of the earbud 110 may be surrounded by skin of the ear 101. The earbud 110 may be wireless in that it does not require a wired connection for use. For instance, the earbud 110 may receive signals wirelessly such as from a music player, phone, or other device to perform a number of functions, such as to generate output, to communicate with other devices, to be charged, etc. The earbud 110 may form a pair with another earbud, such as earbud 510 shown in FIGS. 5 and 6. In some instances, the earbuds 110 and 510 may be truly wireless, where the pair of earbuds 110, 510 are configured to connect to an audio source wirelessly, with no wire between the earbuds 110, 510.

Referring to FIG. 1A, the earbud 110 may include a housing 120, which contains and supports various electronic and/or mechanical components of the earbud 110. The housing 120 may be made of any of a number of materials. For instance, the housing 120 may at least partially be made of a non-conductive material, such as plastic, ceramic, etc. In some instances, the housing 120 may at least partially be made of a non-permeable material that protects components inside the housing 120 from contaminants in the environment.

The earbud 110 may include physical features that allow the earbud 110 to securely and comfortably fit in the ear 101. For example as shown in FIG. 1A, the earbud 110 may include a cap 130 attached to the housing 120. For example, the cap 130 may be attached to one end of the housing 120. In some instances, the cap 130 may have at least one opening 132 such that sound from inside the earbud 110 may travel through the opening 132 to reach outside of the earbud 110. The cap 130 may be made of any of a number of materials. For instance, the cap 130 may at least partially be made of a flexible, non-conductive material, for example, a polymeric material such as rubber or silicone. The cap 130 may be configured to provide a snug fit for the portion of the earbud 110 inserted into the ear 101, such as by changing shape. Flexibility and dimensions of the cap 130 may further accommodate differences in ear anatomy and personal preferences on how to wear the earbud 110. In some instances, the cap 130 may also be configured to provide sound occlusion with respect to sounds originating outside of the earbud 110.

The earbud 110 may further include physical features that provide additional mechanical support. For example and as shown in FIG. 1A, the earbud 110 may further include a support 140 attached to the housing 120. The support 140 may be attached to one end of the housing 120, such as on the same end as the cap 130. The cap 130 may additionally or alternatively be attached to the support 140. In some examples, at least part of the support 140 may be attached to an inside surface of the housing 120 or embedded in the housing 120. As also shown in FIG. 1A, the support 140 may be shaped like a snout of the earbud 110 and configured to fit inside an ear. For example, the support 140 may have a tubular shape. In some instances, the support 140 may be configured as a sound port for the earbud 110 such that sound from inside the earbud 110 may travel through one or more openings in the support 140 to reach outside of the earbud 110. The support 140 may be made of any of a number of materials. For instance, the support 140 may at least partially be made of a conductive material, such as a metal or an alloy.

Referring to FIG. 1B, when the earbud 110 is being worn by the user, the cap 130 and the support 140 may be partially or fully inserted into the ear 101. For instance, the cap 130 may be in direct contact with a skin surface 102 inside the ear 101, such as a skin surface that is part of the ear canal 103. When inserted into the ear 101, the flexible material of the cap 130 may change its shape to provide a secure and comfortable fit.

As shown in FIG. 1B, while being worn, an outside surface of the support 140 may be positioned at a distance dl from the skin surface 102 inside the ear 101. The distance dl may vary, for example within a range, depending on how the earbud 110 is being worn, the flexibility of cap 130, the user's anatomy, and the user's preferences when wearing the earbud (e.g., how far the user prefers to insert the earbud into ear). However, the range may be relatively small because the cap 130 is configured to ensure a consistent fit despite differences in anatomy and preference. By way of example, the cap 130 may be configured with dimensions and flexibility that allows it to change shape within a predetermined range. For instance, the predetermined range may be set between a predetermined diameter for a relatively narrow ear canal and a predetermined diameter for a relatively wide ear canal. Further, the cap 130 may be configured to require a minimum level of compressive force against the ear canal to provide a secure fit. As such, to achieve the minimum level of compressive force, a user with a wider ear canal may want to push the earbud 110 further inside the ear than a user with a narrower ear canal. As such, the range for dl may be relatively small.

Still further, due to the tubular shape of the support 140 that roughly corresponds to the tubular shape of the ear canal 103, the support 140 may have a relatively large surface area A1 that is about a distance dl from the skin surface 102 inside the ear 101. In contrast, due to the small factor of the earbud 110, it may be impracticable for another conductive component inside housing 120 to have a similar surface area. Even in instances where another conductive component inside housing 120 may be configured to have a surface area that is comparable to the surface area A1, points within the surface area may have very different distances to the ear 101.

Figure 2:
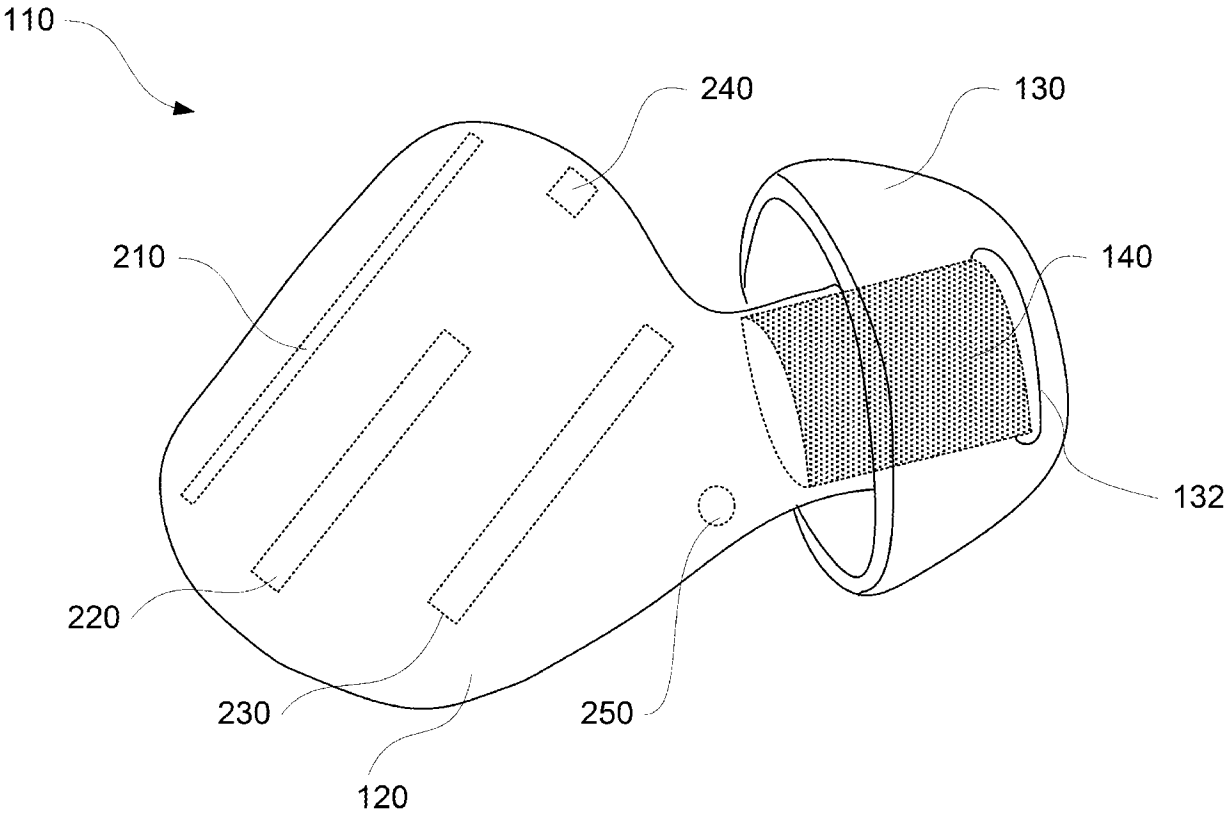
FIG. 2 is a pictorial diagram illustrating components in example earbud in accordance with aspects of the disclosure.

FIG. 2 illustrates some example components of the earbud 110. As shown, various components may be housed inside the housing 120. For example, a circuit board 210, such as a printed circuit board ("PCB") may be provided in the housing 120. The circuit board 210 may provide grounding for other components of the earbud 110. The circuit board 210 may include any of a number of circuits configured to perform any of a number of functions, such as processing information, generating audio, communicating, charging, etc. As another example, a battery 220 may be provided in the housing 120. For instance, the battery 220 may be charged, store energy, and provide energy to other components of the earbud 110.

A speaker 230 may be provided in the housing 120. The speaker 230 may include various components, such as metallic frame, metallic yoke, magnets, coils, amplifiers, diaphragms, and other circuit elements configured to receive analog and/or digital audio signals, and convert these audio signals into sound waves that can be perceived by the ear. For example, the speaker 230 may receive the audio signals from processors of the earbud 110, or from a paired device. In some examples, received audio signals may be processed by circuit elements in the speaker 230 and the circuit board 210, such as by filters, amplifiers, etc. The speaker 230 may be used to play music, emit audio for multimedia files, for voice calls, for translated speech, etc.

As still another example, a diode 240 may be provided inside the housing 120 to protect the electronic components from voltage spike due to static charges. For example, because of the structure and position of the capacitive sensor 137 disposed along support 140, the sensor 137 may be more susceptible to static charges than the other components such as housing 120, circuit board 210, battery 220, and speaker 230. For instance, static charges from the cap 130, which is not inside the housing 120, may be transferred to the support 140. Further, the support 140 may collect additional static charges, such as from skin of the user, in instances where the support 140 is at least partially exposed by the cap 130, for example through the opening 132. Such static charges may cause damage to the support 140, and when transferred to other components inside the housing 120, may also cause damage to these other components. In this regard, the diode 240 may be a transient-voltage-suppression diode. For instance, the support 140 may be connected to a ground on the circuit board 210 through the diode 240.

As discussed further below, the earbud 110 may include various sensors. For example, an optical sensor 250 may be provided inside the housing 120. As an example, the optical sensor 250 may be an infrared (IR) sensor. For instance, the optical sensor 250 may be configured to detect whether the earbud 110 is being worn based on measuring changes in received electromagnetic radiation, such as IR radiation. However, in some instances, the optical sensor 250 may falsely detect other events as the earbuds being worn. Such instances may include when a user touches the earbud 110 with a hand, when the earbud 110 is being placed inside a pocket, when contaminants such as dirt or oil covers a lens, when a lens of the optical sensor 250 has been scratched, etc.

Figure 3A:
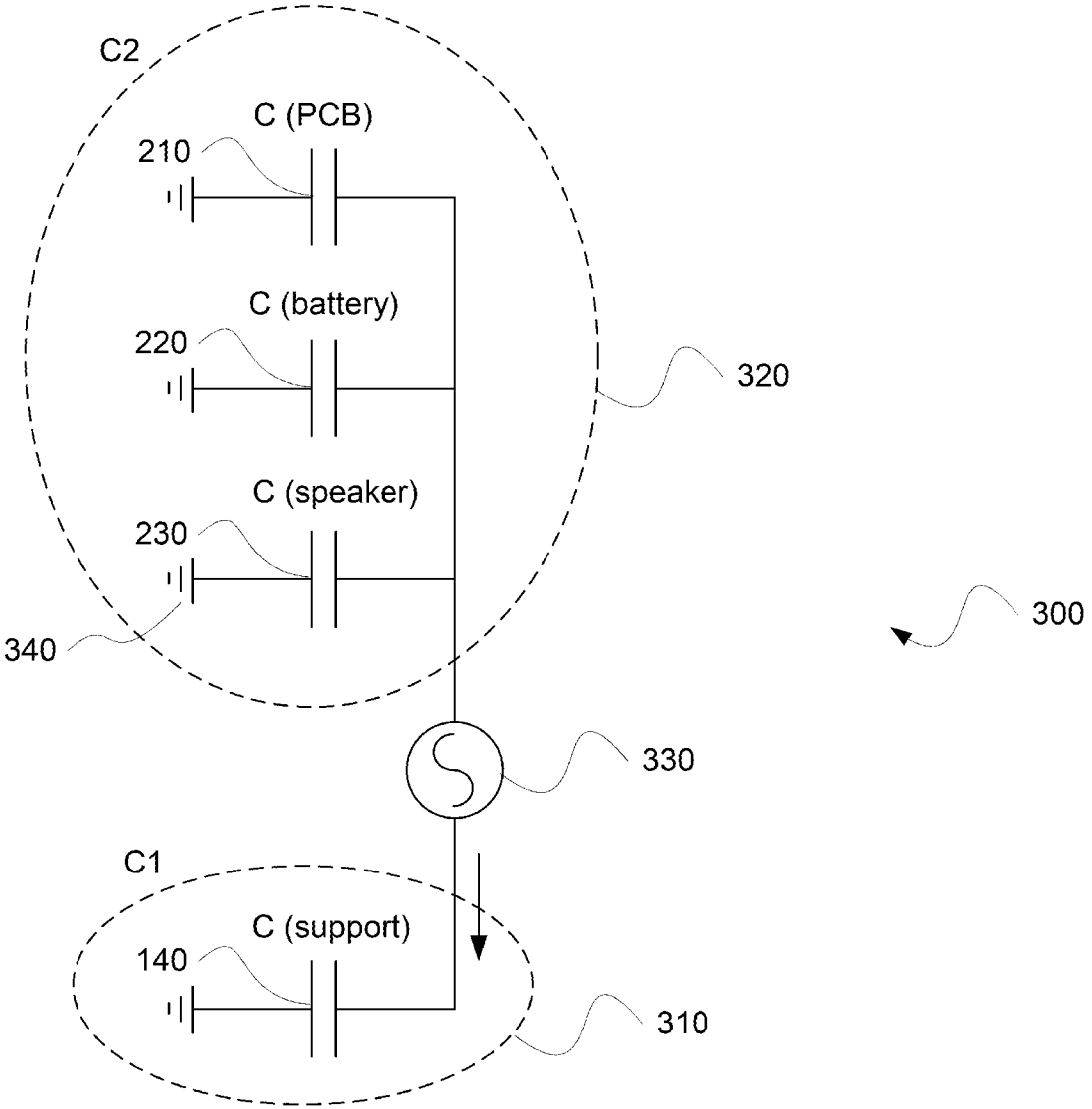
FIGS. 3A and 3B are circuit diagrams illustrating example capacitive sensing circuit in accordance with aspects of the disclosure.
Figure 3B:
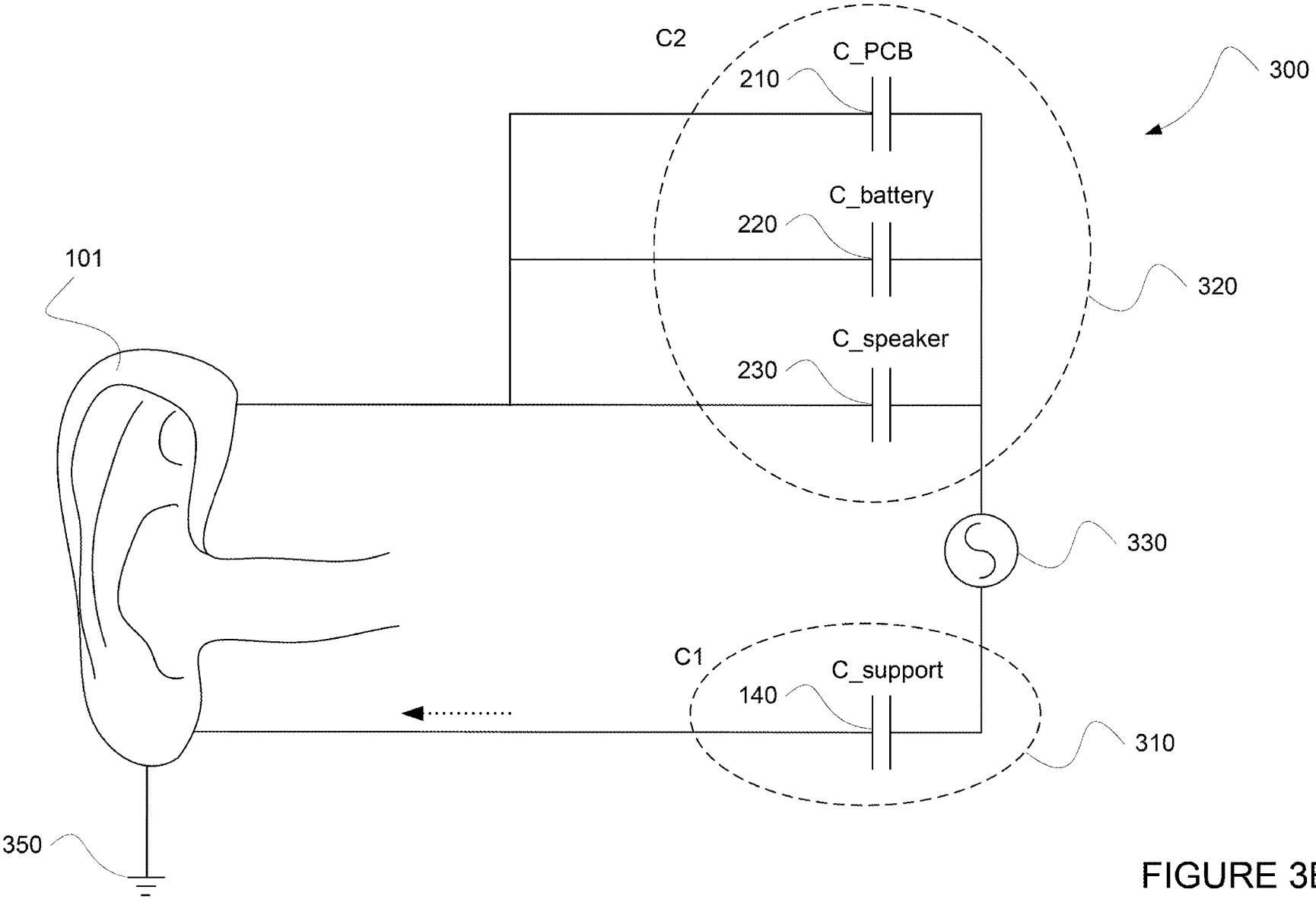

In this regard, a capacitive sensor may be further provided in the earbud 110 for detecting whether the earbud 110 is being worn. The capacitive sensor may include one or more electrodes. Due to the small form factor of the earbud 110, conductive components in the one or more of the components described in FIG. 2 may be used as the electrodes for the capacitive sensor. For instance, FIGS. 3A and 3B show example circuit diagrams for an example capacitive sensor 300. FIG. 3A shows an example circuit diagram when the earbud 110 is not being worn, and FIG. 3B shows an example circuit diagram when the earbud 110 is being worn. Although FIGS. 3A and 3B show a few circuit elements for simplicity, the capacitive sensor 300 may additionally include any of a number of other circuit elements.

Referring to FIGS. 3A and 3B, the capacitive sensor 300 may include a first electrode 310, a second electrode 320, and a detector 330. The first electrode 310 and the second electrode 320 may be connected in series, and when worn, through the ear and body which is essentially conductive. In one aspect, the first electrode 310 may include the support 140, and the second electrode 320 may include one or more conductive components inside the housing 120. For instance, in the example shown, the second electrode 320 includes one or more conductive components of the circuit board 210, one or more conductive components of the battery 220, and one or more conductive components of the speaker 230. Including more conductive components in the second electrode 320 may increase a total capacitance of the second electrode 320, and in turn may increase the combined capacitance measured by the capacitive sensor 300, resulting in larger, more detectable capacitance values. Each of electrodes 310, 320 may be connected to a common ground 340, such as via a wire, a trace, a flex, etc. For example, the ground 340 may be provided on the circuit board 210. In this regard, by using components already existing in the earbuds 110 for capacitive sensing, the capacitive sensor 300 may save more space and be more cost efficient.

Further as shown, the detector 330 may be configured to generate a current (indicated by an arrow) passing through the circuit, such as an AC current or DC current. The detector 330 may be further configured to measure the currents, and determine capacitances based on the measured currents. In this regard, the detector 330 may include circuitry that is part of a processing chip or chipset, and may include one or more processors. For instance, since the first electrode 310 and the second electrode 320 are shown connected in series, the current may have a waveform before passing through the first electrode 310 and the second electrode 320, and a different waveform after passing through the first electrode 310 and the second electrode 320. Based on the changes, the detector 330 may measure a combined capacitance for the circuit including the first electrode 310 and the second electrode 320.

When the earbud 110 is far away from the ear 101 as shown in FIG. 3A, the first electrode 310 may be more than a predetermined distance away from the ear 101, and the second electrode 320 may be more than a second predetermined distance away from the ear 101. As such, capacitances of the first electrode 310 and/or second electrode 320 may not be affected by the ear 101. For example, a first capacitance C1 may have a value C_support for the first electrode 310, a second capacitance C2 may have value C_PCB+C_battery+C_speaker for the second electrode 320, so that the capacitive sensor 300 measures a combined capacitance C_capsenseor=C1*C2/(C1+C2).

Based on the capacitance values C1, C2, one or more processors of the detector 330 may detect that the earbud 110 is not being worn. For instance, the one or more processors may compare C_capsensor with a predetermined threshold capacitance, and detect that the earbud 110 is not being worn based on C_capsensor not meeting the predetermined threshold capacitance.

Referring to FIG. 3B, when the earbud 110 is worn in the ear 101, the first electrode 310 may come within the predetermined distance from the ear 101 and/or the second electrode 320 may come within the second predetermined distance from the ear 101. For example, the first electrode 310 may be at a distance dl shown in FIG. 1B. As such, capacitances of the first electrode 310 and/or second electrode 320 may be affected by the ear 101. For instance, a portion of the current (indicated by dotted arrow) from detector 330 may be diverted through the ear 101 to a virtual ground 350 inside the user's body. As such, detector 330 may measure that the combined capacitance formed by the first capacitance C1 and the second capacitance C2 have changed values than the example situation shown in FIG. 3A.

Based on the capacitance values C1, C2, one or more processors of the detector 330 may detect that the earbud 110 is being worn. For instance, the one or more processors may compare C_capsensor with the predetermined threshold capacitance, and detect that the earbud 110 is being worn based on C_capsensor meeting the predetermined threshold capacitance.

As shown and described earlier with respect to FIG. 1B, the support 140 provides a more consistent, and smaller distance dl to the user's ear 101 than other components of the earbud 110, including the circuit board 210, the battery 220, and the speaker 230. Further, due to the small factor of the earbud 110, using an additional component inside the housing 120 as the sensing electrode may not achieve the same small distance as the support 140. Moreover, as discussed earlier, the support 140 may provide a larger surface area A1 shown in FIG. 1B than other components of the earbud 110, and the surface area A1 may also maintain a more consistent distance from the ear 101 when being worn than other components.

Since capacitance varies as a function of distance and as a function of surface area, including capacitive measurement at support 140 for in-ear detection may provide a more reliable detection.

Detection using capacitance measurements including capacitance at the first electrode 310 may be further advantageous because it is less likely to produce false positives. For instance, while the user may touch various portions of the housing 120 with hands, once inserted into the ear 101, the cap 130 and portions of the housing 120 near the support 140 are likely not accessible to the user's hand. In some instances, even while the user is adjusting the earbud 110 in the ear 101, because support 140 is a pivoting point, there would be less variation in distance and surface area, thus resulting in more reliable capacitance measurements. Further, detection based on capacitance measurements including the capacitance at the first electrode 310 may additionally be advantageous because the support 140 is likely to come close to the ear 101 first, since it is the portion to be inserted. As such, using the first electrode 310 may allow earlier detection.

In another aspect, capacitance measurements including capacitance at the first electrode 310 may be further used for detecting whether the earbud 110 is being worn correctly. For instance, if the cap 130 is removed from the earbud 110, support 140 may come in direct contact with the skin surface 102 inside the ear 101. Since combined capacitance of the capacitive sensor 300 may be affected to a greater extent by the user's body with direct contact (than indirect contact through the cap 130), a higher combined capacitance may be measured by the detector 330. As such, the one or more processors may determine, for example based on detecting that the combined capacitance C_capsensor meeting a predetermined high threshold capacitance, that the earbud 110 is being worn without the cap 130. For example, C1 may be shorted by direct contact with skin such that C_capsensor=C2. In some instances, removing the cap 130 may result in poorer sound quality or discomfort to the ear. In this regard, the one or more processors may be configured to generate an output instructing the user to put the cap 130 back on.

Figure 4:
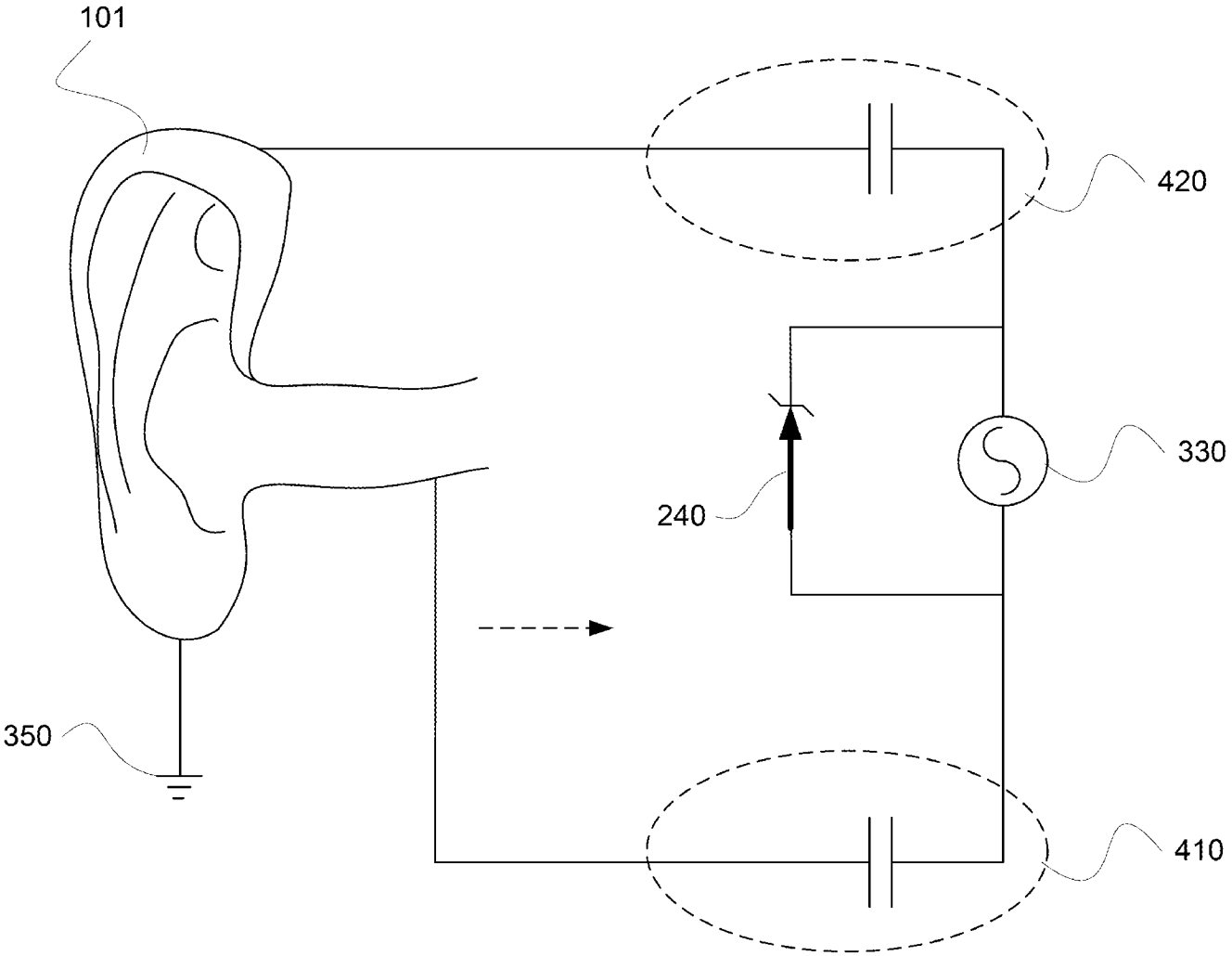
FIG. 4 is another circuit diagram illustrating example capacitive circuit in accordance with aspects of the disclosure.

FIG. 4 shows another example circuit diagram illustrating another example capacitive sensor 400. Example capacitive sensor 400 may include many of the features of example sensor 300, such as first electrode 410 and second electrode 420, details of which are omitted. As shown, the capacitive sensor 400 may further include diode 240 connected in parallel with the detector 330 to protect the detector 330 from electrostatic discharge. As mentioned earlier, static charges (indicated by dashed arrow) may be transferred from the user to the support 140, and in turn to the detector 330. The excess current from the static charges may be shunted by the diode 240 when the induced voltage exceeds the avalanche breakdown potential of the diode 240. Although the examples of FIGS. 3A, 3B, and 4 include two electrodes, in other examples the device may include additional electrodes. In such cases the combined capacitance may be determined further based on capacitance of the additional electrodes.

Figure 5:
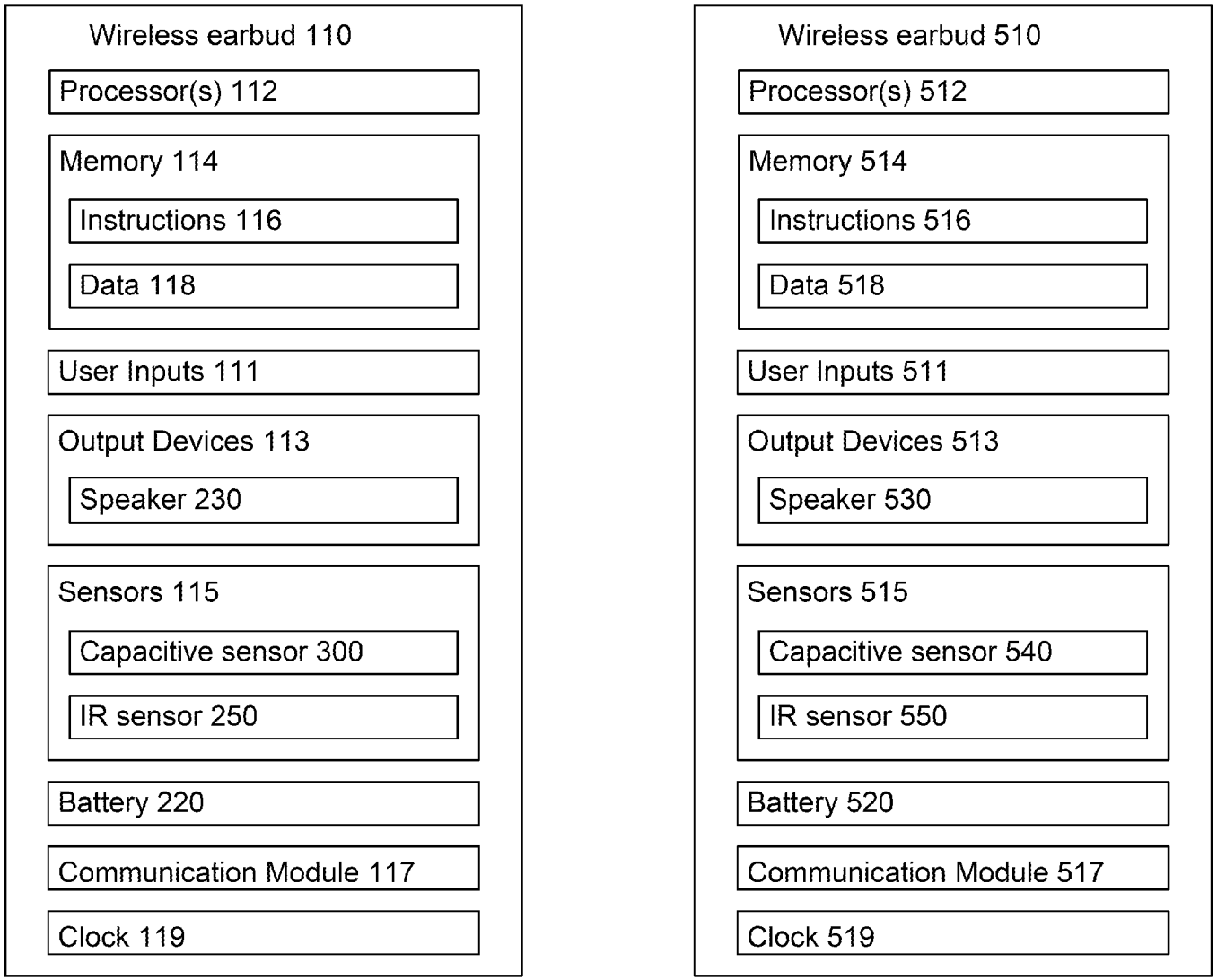
FIG. 5 is a block diagram of example pair of earbuds in accordance with aspects of the disclosure.

FIG. 5 is a functional block diagram of a pair of earbuds 110, 510 in which the features described herein may be implemented. It should not be considered as limiting the scope of the disclosure or usefulness of the features described herein. For example as shown, the earbud 110 may contain one or more processors 112, memory 114 and other components typically present in general purpose computing devices, and the earbud 510 may similarly contain one or more processors 512, memory 514 and other components typically present in general purpose computing devices. The earbud 510 may similarly contain battery 520, speaker 530, Memories 114, 514 can store information accessible by the one or more processors 112, 512, including instructions 116, 516, that can be executed by the one or more processors 112, 512. Memories 114, 514 can also include data 118, 518 that can be retrieved, manipulated or stored by the processors 112, 512. The memories can be of any non-transitory type capable of storing information accessible by the processor, such as a hard-drive, memory card, ROM, RAM, DVD, CD-ROM, write-capable, and read-only memories.

The instructions 116, 516 can be any set of instructions to be executed directly, such as machine code, or indirectly, such as scripts, by the one or more processors. In that regard, the terms "instructions," "application," "steps" and "programs" can be used interchangeably herein. The instructions can be stored in object code format for direct processing by a processor, or in any other computing device language including scripts or collections of independent source code modules that are interpreted on demand or compiled in advance. Functions, methods and routines of the instructions are explained in more detail below.

Data 118, 518 can be retrieved, stored or modified by the one or more processors 112, 512 in accordance with the instructions 116, 516. For instance, although the subject matter described herein is not limited by any particular data structure, the data can be stored in computer registers, in a relational database as a table having many different fields and records, or XML documents. The data can also be formatted in any computing device-readable format such as, but not limited to, binary values, ASCII or Unicode. Moreover, the data can comprise any information sufficient to identify the relevant information, such as numbers, descriptive text, proprietary codes, pointers, references to data stored in other memories such as at other network locations, or information that is used by a function to calculate the relevant data.

The one or more processors 112, 512 can be any conventional processors, such as a commercially available CPU. Alternatively, the processors can be dedicated components such as an application specific integrated circuit ("ASIC") or other hardware-based processor. Although not necessary, the earbuds 110, 510 may include specialized hardware components to perform specific computing processes, such as decoding video, matching video frames with images, distorting videos, encoding distorted videos, etc. faster or more efficiently.

Although FIG. 5 functionally illustrates the processor, memory, and other elements of earbuds 110, 510 as being within the same block, the processor, computer, computing device, or memory can actually comprise multiple processors, computers, computing devices, or memories that may or may not be stored within the same physical housing. For example, the memory can be a hard drive or other storage media located in housings different from that of the earbuds 110, 510. Accordingly, references to a processor, computer, computing device, or memory will be understood to include references to a collection of processors, computers, computing devices, or memories that may or may not operate in parallel.

Further as shown in FIG. 5, earbuds 110, 510 may include one or more user inputs, such as user inputs 111, 511 respectively. For instance, user inputs may include mechanical actuators, soft actuators, periphery devices, sensors, and/or other components. Examples of sensors in inputs 111, 511 may include vibration sensors, such as microphones, touch sensors, such as capacitive or optical sensors, etc. For example, users may be able to control various audio characteristics using the user inputs 111, 511, such as turning audio on and off, adjusting volume, etc.

Earbuds 110, 510 may include one or more outputs devices, such as output devices 113, 513 respectively. For instance, output devices may include one or more speakers, transducers or other audio outputs, a user display, a haptic interface or other tactile feedback that provides non-visual and non-audible information to the user. For example, speakers in output devices 113, 513 may be used to play music, emit audio for navigational or other guidance, for multimedia files, for voice calls, for translated speech, etc.

Earbuds 110, 510 may include one or more sensors, such as sensors 115, 515 respectively. For instance, sensors 115, 515 may include capacitive sensors, such as capacitive sensors 300, 540. Sensors 115, 515 may also each include optical sensors, such as optical sensors 250, 550. Other examples of sensors may further include an Inertial Measurement Unit ("IMU"), a barometer, a vibration sensor, a heat sensor, a radio frequency (RF) sensor, a magnetometer, and a barometric pressure sensor. Additional or different sensors may also be employed.

To obtain information from and send information to each other, as well as to other remote devices, earbuds 110, 510 may each include a communication module, such as communication modules 117, 517 respectively. The communication modules may enable wireless network connections, wireless ad hoc connections, and/or wired connections. Via the communication modules 117, 517, the earbuds 110, 510 may establish communication links, such as wireless links. The communication modules 117, 517 may be configured to support communication via cellular, LTE, 4G, WiFi, GPS, and other networked architectures. The communication modules 117, 517 may be configured to support Bluetooth®, Bluetooth LE, near field communications, and non-networked wireless arrangements. The communication modules 117, 517 may support wired connections such as a USB, micro USB, USB type C or other connector, for example to receive data and/or power from a laptop, tablet, smartphone or other device.

The earbuds 110, 510 may each include one or more internal clocks 119, 519. The internal clocks may provide timing information, which can be used for time measurement for apps and other programs run by the computing devices, and basic operations by the computing devices, sensors, inputs/outputs, GPS, communication system, etc.

Figure 6:
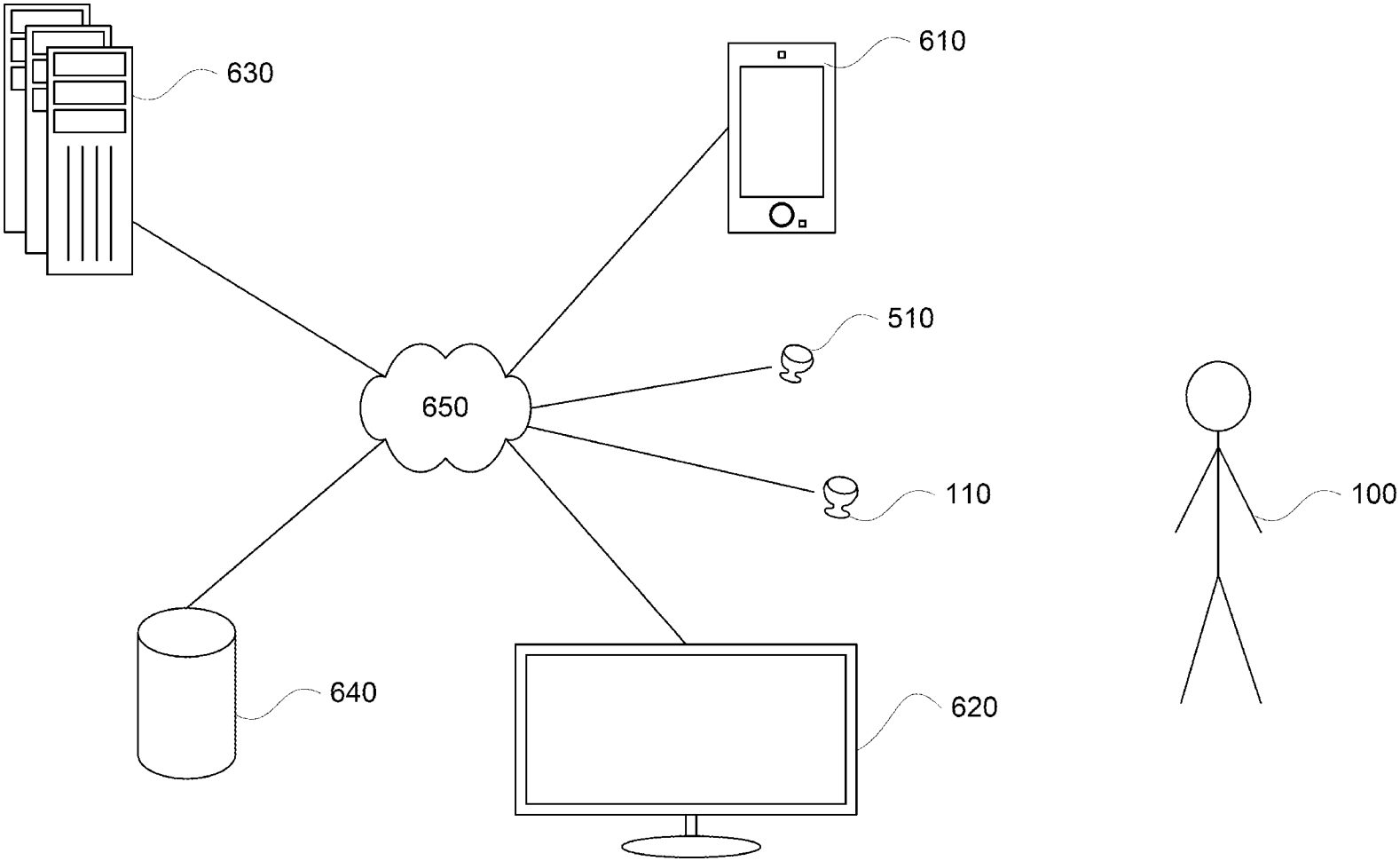
FIG. 6 is a block diagram of example system in accordance with aspects of the disclosure.

Using the communication modules 117, 517, earbuds 110, 510 may communicate with other devices in a system via a network. For instance, FIG. 6 is a pictorial diagram illustrating an example system 600 in which the features described herein may be implemented. The system 600 may include the earbuds 110, 510, computing devices 610, 620, 630, and a storage system 640. As shown, the earbuds 110, 510, computing devices 610, 620, 630, and storage system 640 can each be at different nodes of a network 650 and capable of directly and indirectly communicating with other nodes of network 650. Although only a few computing devices are depicted in FIG. 6, it should be appreciated that a typical system can include a large number of connected computing devices, with each different computing device being at a different node of the network 650.

The network 650 and intervening nodes described herein can be interconnected using various protocols and systems, such that the network can be part of the Internet, World Wide Web, specific intranets, wide area networks, or local networks. The network can utilize standard communications protocols, such as Ethernet, WiFi and HTTP, protocols that are proprietary to one or more companies, and various combinations of the foregoing. Although certain advantages are obtained when information is transmitted or received as noted above, other aspects of the subject matter described herein are not limited to any particular manner of transmission of information.

Each of the computing devices 610, 620, 630 may be configured similarly to the earbuds 110, 510, with one or more processors, memory and instructions as described above. For instance, computing devices 610 and 620 may each be a client device intended for use by a user, such as user, and have all of the components normally used in connection with a personal computing device such as a central processing unit (CPU), memory (e.g., RAM and internal hard drives) storing data and instructions, user inputs and/or outputs, sensors, communication module, positioning system, clock, etc. For example, communication modules of computing devices 610, 620 may similarly include one or more antennas for transmitting and/or receiving signals, such as Bluetooth® signals, and may also be configured to measure signal strengths of communication links. As another example, computing devices 610, 620 may have the same and/or different types of user inputs and/or outputs as earbuds 110, 510, such as a screen or touchscreen for displaying texts, images, videos, etc. As yet another example, computing device 630 may be a server computer and may have all of the components normally used in connection with a server computer, such as processors, and memory storing data and instructions.

The computing devices 610, 620, and 630 may each comprise a full-sized personal computing device, or may alternatively comprise mobile computing devices capable of wirelessly exchanging data with a server over a network such as the Internet. For example, computing device 610 may be a mobile device, such as a mobile phone as shown in FIG. 6, or some other mobile device such as a wireless-enabled PDA. As another example, computing device 620 may be a laptop computer as shown in FIG. 6, or some other computing device such as a desktop computer, a tablet, or other smart device that is capable of obtaining information via communication links. In other examples (not shown), system 600 may additionally or alternatively include wearable devices, such as a smartwatch, a head mount device, etc.

As with memories 114, 514, storage system 640 can be of any type of computerized storage capable of storing information accessible by one or more of the earbuds 110, 510, and computing devices 610, 620, 630, such as a hard-drive, memory card, ROM, RAM, DVD, CD-ROM, write-capable, and read-only memories. In addition, storage system 640 may include a distributed storage system where data is stored on a plurality of different storage devices which may be physically located at the same or different geographic locations. Storage system 640 may be connected to the computing devices via the network 650 as shown in FIG. 6 and/or may be directly connected to any of earbuds 110, 510, and computing devices 610, 620, 630.

Example Methods

Further to example systems described above, example methods are now described. Such methods may be performed using the systems described above, modifications thereof, or any of a variety of systems having different configurations. It should be understood that the operations involved in the following methods need not be performed in the precise order described. Rather, various operations may be handled in a different order or simultaneously, and operations may be added or omitted.

Figure 7:
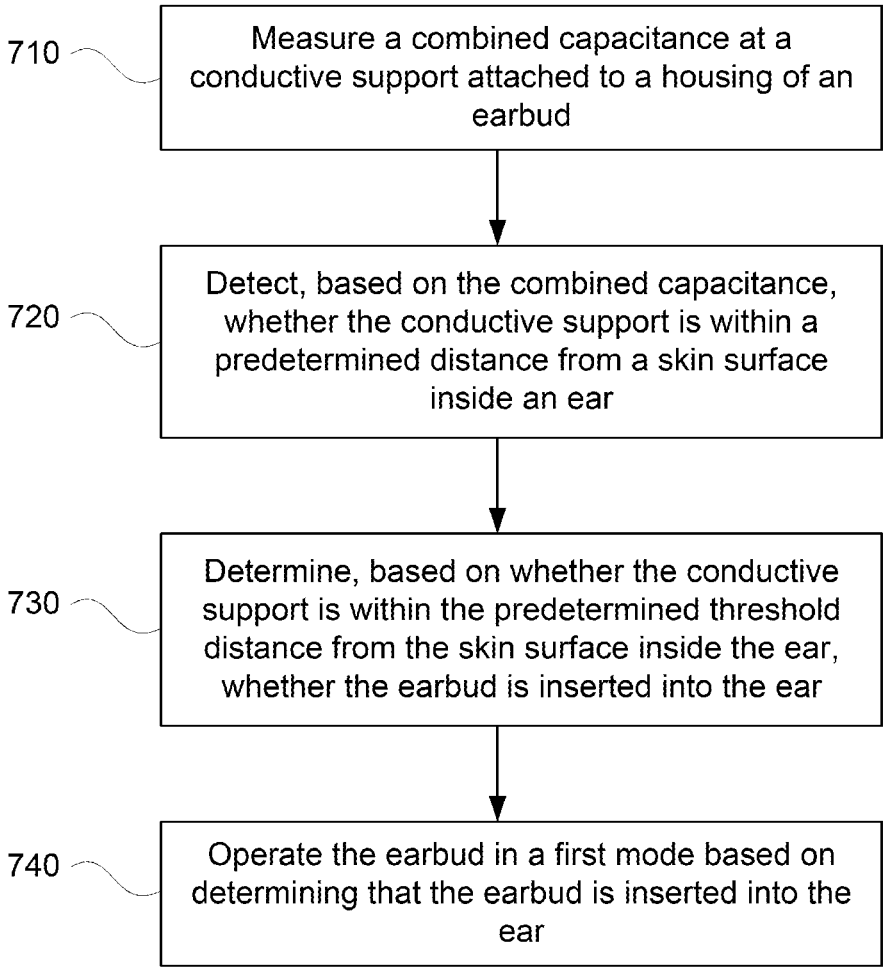
FIG. 7 is example flow diagram in accordance with aspects of the disclosure.

For instance, FIG. 7 shows an example flow diagram that may be performed by one or more processors, such as one or more processors 112 and/or 512. For example, processors 112 and/or 512 may receive data and make various determinations as shown in the flow diagram. Referring to FIG. 7, in block 710, a combined capacitance is measured at a conductive support attached to a housing of an earbud. In block 720, it is detected, based on the combined capacitance, whether the conductive support is within a predetermined distance from a skin surface inside an ear. In block 730, it is determined, based on whether the conductive support is within the predetermined distance from the skin surface inside the ear, whether the earbud is inserted into the ear. In block 740, the earbud is operated in a first mode based on determining that the earbud is inserted into the ear. Although not shown, for a pair of earbuds such as earbuds 110 and 510, the two earbuds 110 and 510 may be operated in the same mode or different modes based on detecting whether both are inserted into the ear.

Figure 8:
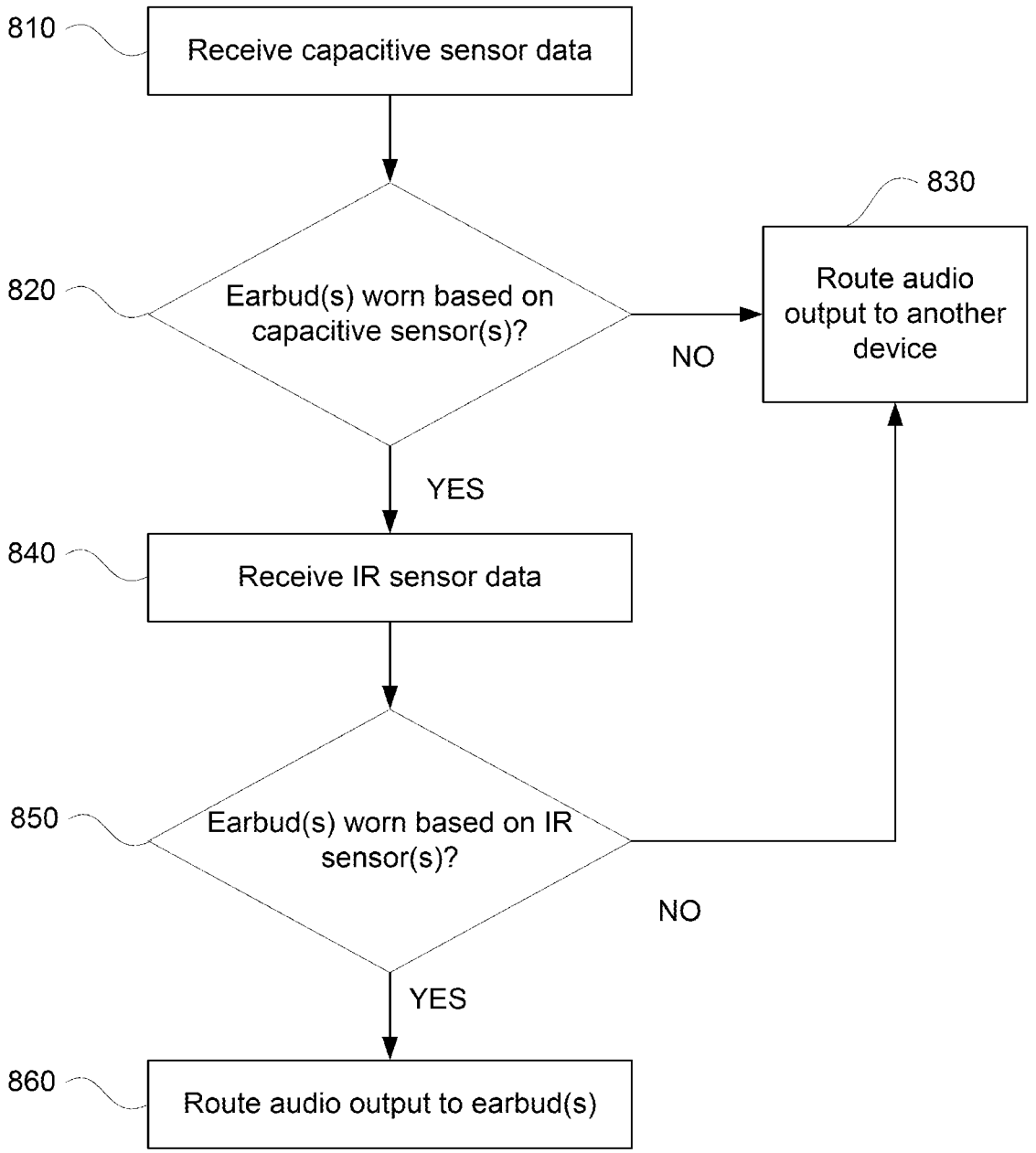
FIG. 8 is example flow diagram in accordance with aspects of the disclosure.

For instance, FIG. 8 shows an example flow diagram that may be performed by one or more processors, such as one or more processors 112 and/or 512. For example, processors 112 and/or 512 may receive data and make various determinations as shown in the flow diagram. Referring to FIG. 8, at block 810, capacitive sensor data is received. For example, the capacitive sensor data may be a combined capacitance measurement including capacitance C1 of the first electrode 310 and capacitance C2 of the second electrode 320 shown in FIG. 3A or 3B. At block 820, it is determined based on the capacitive sensor data whether the earbud(s) are being worn. For example, the processors 112 may compare the combined capacitance measurement to a predetermined threshold capacitance. If not, at block 830, audio output is routed to another electronic device. For example, the processors 112 may determine that the combined capacitance measurement does not meet the predetermined threshold capacitance. For example, the processors 112 may send a message to another device such as device 610 to generate audio output. For instance, the processors 112 may send the message using communication modules 117 and/or 517 via network 650.

If yes, at block 840, IR sensor data is received. For example, the processors 112 may determine that the combined capacitance measurement meets the predetermined threshold capacitance. For example, IR sensor data may include changes in IR radiation received by the optical sensor 250. At block 850, it is determined based on IR sensor data whether the earbud(s) are being worn. For example, the processors 112 may compare the IR sensor data with a predetermined threshold value. If yes, at block 860, audio output is routed to the earbud(s). For example, the processors 112 may control the speaker 230 to generate audio output. If not, at block 830, audio output is routed to another electronic device.

In this regard, the use of two different types of sensors detecting whether the earbud(s) are being worn may reduce the number of false detections. For instance, sensing inaccuracies of the capacitive sensor may be caused by different factors as the IR sensor. For example, whereas IR sensors may have inaccurate detections resulting from hand touches, being placed inside a pocket, and contaminants and scratches on a lens, capacitive sensors may have inaccurate detections resulting from other factors, such as variations in separation distance, contact surface area, dielectric changes as a result of temperature variation, etc. Since it is less likely that both types of factors exist, it is less likely that both sensors will produce detection errors at the same time.

Figure 9:
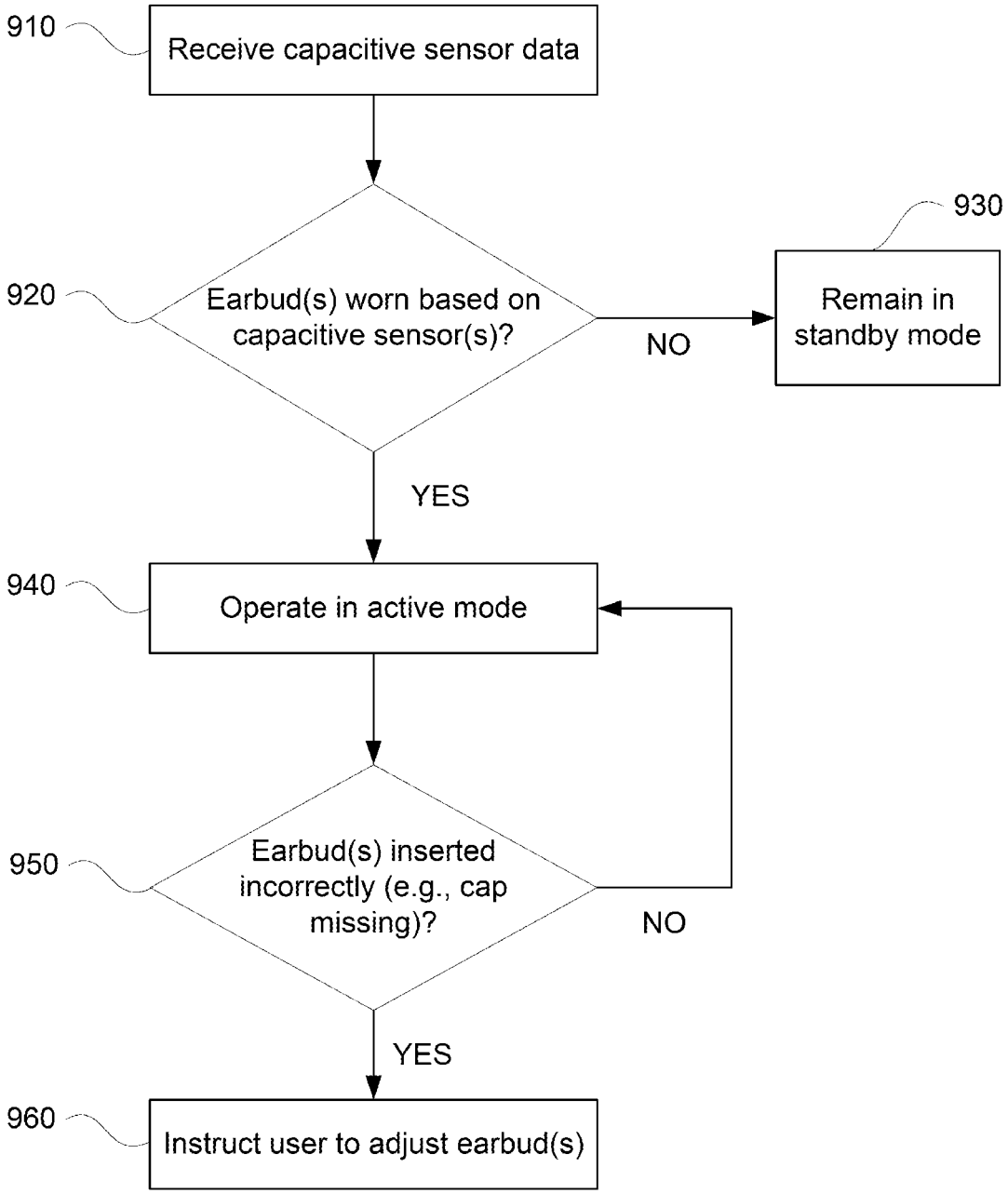
FIG. 9 is example flow diagram in accordance with aspects of the disclosure.

FIG. 9 shows another example flow diagram that may be performed by one or more processors, such as one or more processors 112 and/or 512. For example, processors 112 and/or 512 may receive data and make various determinations as shown in the flow diagram. Referring to FIG. 9, at block 910, capacitive sensor data is received. At block 920, it is determined based on the capacitive sensor data whether the earbud(s) are being worn. If not, at block 930, the earbud(s) are controlled to remain in a standby mode. For example, the standby mode may be one in which the earbuds 110, 510 operate using less power, such as having some of its functions turned off, and/or having sensing or communication capabilities turned to a lower frequency.

If yes, at block 940, the earbud(s) are controlled to enter an active mode. For example, the active mode may be one in which the earbuds 110, 510 are generating audio output, or sensing and/or communicating at a higher frequency than the standby mode. At block 950, it is determined whether the earbud(s) are inserted incorrectly. For example, processors 112 may determine that the cap 130 is removed from the earbud 110 based on detecting a combined capacitance at the first electrode 310 meeting a predetermined high threshold capacitance. If yes, at block 960, an output is generated to instruct the user to adjust the earbud(s). For example, processors 112 may control speaker 230 to generate an audio output instructing the user to adjust the earbud 110. As another example, processors 112 may send a message to another device such as device 610 to generate an output instruction for the user, such as via a display or a speaker. If not, at block 930, the earbud(s) remain in the active mode.

The technology is able to detect, with relatively high accuracy, whether a person is currently wearing a device on their body, such as an earbud in an ear. Accuracy is enhanced by the use of a capacitive component that is inserted into the ear, which permits the component to maintain a consistent distance from the skin surface inside the ear. Accuracy may be further enhanced by the component's geometry, which provides a relatively large surface area despite the small form factor of the device. Different types of sensors may additionally be used for on-body detection, which may further reduce false positives. Accurate on-body detection may result in longer battery life because, among other reasons, the earbud may enter a standby state, or otherwise decrease its power usage when it is not being worn. In addition, user experience may be improved by routing audio to the most appropriate device. User experience may be further improved by detecting when the earbud is worn incorrectly and providing instructions to the user to help the user adjust the earbud.

Unless otherwise stated, the foregoing alternative examples are not mutually exclusive, but may be implemented in various combinations to achieve unique advantages. As these and other variations and combinations of the features discussed above can be utilized without departing from the subject matter defined by the claims, the foregoing description of the embodiments should be taken by way of illustration rather than by way of limitation of the subject matter defined by the claims. In addition, the provision of the examples described herein, as well as clauses phrased as "such as," "including" and the like, should not be interpreted as limiting the subject matter of the claims to the specific examples; rather, the examples are intended to illustrate only one of many possible embodiments. Further, the same reference numbers in different drawings can identify the same or similar elements.

The invention claimed is:

1. A device, comprising:

a housing;

a conductive support attached to the housing; and one or more processors configured to:

measure a combined capacitance of a plurality of electrodes, wherein a first electrode of the plurality of electrodes is located at the conductive support and a second electrode of the plurality of electrodes is located within the housing;

detect, based on the combined capacitance, whether the device is inserted incorrectly into an ear;

generate, based on detecting that the device is inserted incorrectly, an output including an instruction; and operate the device in a first mode based on detecting that the conductive support is inserted into the ear.

2. The device of claim 1, wherein the one or more processors are further configured to:

determine that the combined capacitance meets a predetermined threshold capacitance, wherein detecting whether the conductive support is inserted into the ear is based on whether the combined capacitance meeting the predetermined threshold capacitance.

3. The device of claim 1, wherein the conductive support has a tubular shape configured to be inserted into an ear canal.

4. The device of claim 1, further comprising a speaker.

5. The device of claim 4, wherein the one or more processors are further configured to control the speaker to generate an audio output when operating in the first mode.

6. The device of claim 1, wherein the one or more processors are further configured to operate the device in a second mode based on detecting that the conductive support is not inserted into the ear.

7. The device of claim 6, wherein the second mode is a standby mode.

8. The device of claim 6, further comprising:

a communication module;

wherein the one or more processors are further configured to control the communication module to send a message instructing another electronic device to generate audio output when operating in the second mode.

9. The device of claim 1, further comprising:

a non-conductive cap positioned around the conductive support outside the housing, wherein, when the conductive support is inserted into the ear, the non-conductive cap comes in direct contact with a skin surface of the ear.

10. The device of claim 9, wherein the instruction comprises an instruction to adjust the non-conductive cap.

11. The device of claim 1, further comprising:

a speaker;

a battery;

a circuit board;

wherein the speaker, the battery, the circuit board, and the conductive support are connected to a common ground;

wherein the combined capacitance includes a first capacitance of the conductive support, and a second capacitance across the speaker, the battery, and the circuit board.

12. The device of claim 1, further comprising:

a detector for measuring the combined capacitance; and a transient-voltage-suppression diode connected in parallel to the detector.

13. The device of claim 1, further comprising:

an optical sensor positioned inside the housing;

wherein the one or more processors are further configured to:

receive sensor data from the optical sensor;

detect, further based on the sensor data from the optical sensor, that the conductive support is inserted into the ear.

14. A system, comprising:

a first earbud, including:

a first housing;

a first conductive support attached to the first housing; and one or more processors configured to:

measure a first combined capacitance of a first plurality of electrodes at the first conductive support;

measure a second capacitance of at least one other electrode at the first housing, wherein the at least one other electrode comprises at least one conductive component within the first housing;

detect, based on the combined capacitance, whether the first conductive support is inserted incorrectly into an ear;

generate, based on detecting that the first conductive support is inserted incorrectly, an output including an instruction; and operate the first earbud in a first mode based on detecting that the first conductive support is inserted into the ear.

15. The system of claim 14, wherein the first mode includes controlling the first earbud to generate an audio output.

16. The system of claim 14, further comprising:

a second earbud, including:

a second housing;

a second conductive support attached to the second housing;

wherein the one or more processors are further configured to:

measure a second combined capacitance of a second plurality of electrodes at the second conductive support;

detect, based on the second combined capacitance, that the second conductive support is not inserted into an ear;

operate the second earbud in a second mode based on detecting that the second conductive support is not inserted into the ear.

17. The system of claim 16, wherein the second mode is a standby mode.

18. A method, comprising:

measuring, by one or more processors, a combined capacitance of a plurality of electrodes, wherein a first electrode of the plurality of electrodes is located at a conductive support attached to a housing of a device and a second electrode of the plurality of electrodes is located within the housing;

determining, by the one or more processors based on the combined capacitance, whether the conductive support is inserted incorrectly into an ear;

generating, based on detecting that the conductive support is inserted incorrectly, an output including an instruction; and operating, by the one or more processors, the device in a first mode based on determining that the device is inserted into the ear.

19. The method of claim 18, further comprising:

receiving, by the one or more processors, sensor data from an optical sensor;

detecting, by the one or more processors further based on the sensor data from the optical sensor, whether the device is being worn.

20. The device of claim 1, further comprising at least one electrode inside the housing, wherein at least one electrode inside the housing includes one or more conductive components inside the housing, and wherein the one or more processors are further configured to measure the combined capacitance of the plurality of electrodes at the conductive support and the at least one electrode inside the housing.

* * * * *